US006179691B1

(12) United States Patent
Lee et al.

(10) Patent No.: US 6,179,691 B1
(45) Date of Patent: Jan. 30, 2001

(54) METHOD FOR ENDPOINT DETECTION FOR COPPER CMP

(75) Inventors: Fu-Sheng Lee, Tai-Chung; Chien-Chen Chen, Hsin-Chu; Jiun-Chung Lee, Taoyuan; Hsin-Chieh Huang, Hsin-Chu, all of (TW)

(73) Assignee: Taiwan Semiconductor Manufacturing Company, Hsin-Chu (TW)

( * ) Notice: Under 35 U.S.C. 154(b), the term of this patent shall be extended for 0 days.

(21) Appl. No.: 09/368,860

(22) Filed: Aug. 6, 1999

(51) Int. Cl.[7] ..... A61F 2/64

(52) U.S. Cl. ..... 451/41; 451/28; 451/36; 451/288

(58) Field of Search ..... 451/41, 60, 5, 451/285, 286, 287, 288, 289, 36, 37, 39, 93, 28

(56) References Cited

U.S. PATENT DOCUMENTS

| | | | | |
|---|---|---|---|---|
| 3,792,253 | * | 2/1974 | Wylie et al. | 250/83.3 R |
| 3,986,029 | * | 10/1976 | Koske et al. | 250/336 |
| 4,147,564 | | 4/1979 | Magee et al. | 148/1.5 |
| 4,515,889 | * | 5/1985 | Klose et al. | 435/4 |
| 5,059,802 | * | 10/1991 | Filthuth | 250/374 |
| 5,622,525 | * | 4/1997 | Haisma et al. | 451/41 |
| 5,637,185 | | 6/1997 | Murarka et al. | 438/5 |
| 5,648,268 | * | 7/1997 | Batchelder et al. | 436/57 |
| 5,722,875 | | 3/1998 | Iwashita et al. | 451/8 |
| 5,836,805 | | 11/1998 | Obeng | 451/36 |
| 5,864,398 | * | 1/1999 | Murnick | 356/311 |
| 6,012,967 | * | 1/2000 | Satake et al. | 451/36 |
| 6,015,333 | * | 1/2000 | Obeng | 451/8 |
| 6,037,258 | * | 3/2000 | Liu et al. | 438/687 |

* cited by examiner

*Primary Examiner*—Lee Young
*Assistant Examiner*—Minh Trinh
(74) *Attorney, Agent, or Firm*—George O. Saile; Stephen B. Ackerman

(57) ABSTRACT

A copper isotope is added to the layer of copper that is deposited to form the metal interface. Radioactivity emitted by the copper layer is measured during copper polishing, endpoint of the copper CMP is reached when this radioactivity starts to rapidly decrease. Another approach is to measure the radioactivity of the copper slurry that is removed during copper polishing. Polishing end-point is reached when the copper slurry radioactivity starts to rapidly increase. Yet another approach is to add copper isotopes to the copper seed layer and measure the radioactivity emitted by the seed layer. Polishing end-point is reached when the radioactivity emitted by the seed layer starts to rapidly increase.

14 Claims, 4 Drawing Sheets

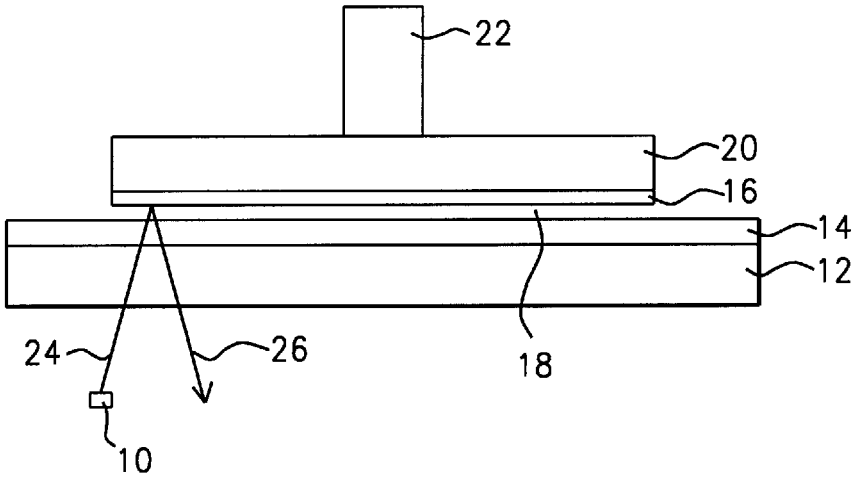
FIG. 1 – Prior Art
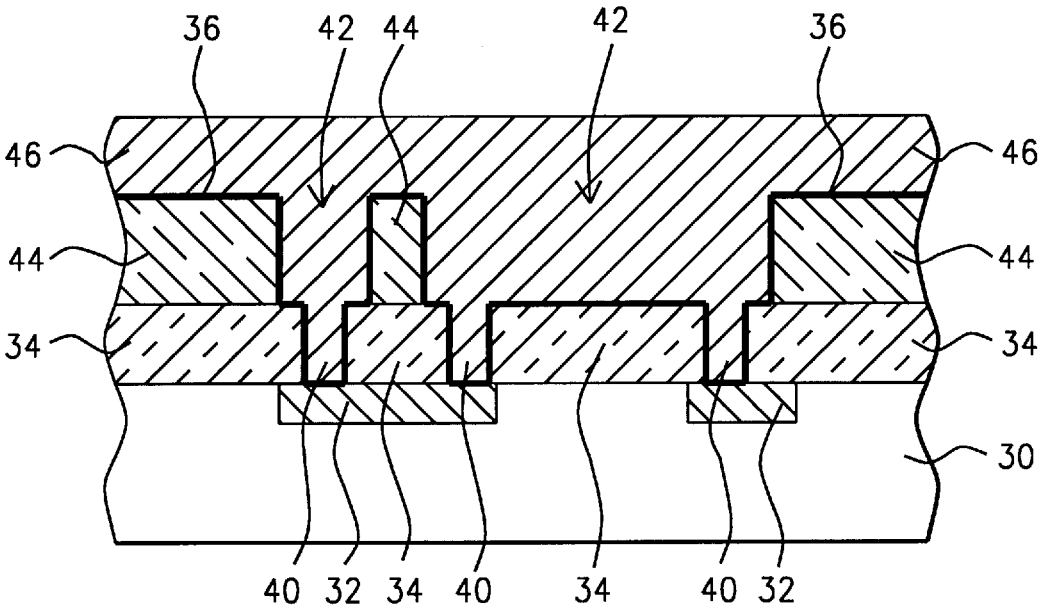
FIG. 2

METHOD FOR ENDPOINT DETECTION FOR COPPER CMP

BACKGROUNG OF THE INVENTION (1) Field of the Invention

The invention relates to the fabrication of integrated circuit devices, and more particularly, to a method of end point detection for the copper Chemical Mechanical Polishing process.

(2) Description of the Prior Art

In forming semiconductor devices a large number of complex processing steps are required to form particular device features, these processing steps typically use and depend on a flat surface in order to perform their operation. The creation of semiconductor devices further results in creating these devices in a number of layers of material which further complicates the required processing steps since planarity must also be maintained from layer to layer within the device structure. Good surface planarity is critically important to lithography processes since these processes depend on maintaining depth of focus. Two common techniques used to achieve planarity on a semiconductor surface are a Spin-On-Glass (SOG) etchback process and a Chemical Mechanical Polishing (CMP) process. Although both processes improve planarity on the surface of a semiconductor wafer, CMP has been shown to have a higher level of success in improving global planarity.

Because dimensions if Integrated Circuit (IC) devices within advanced IC's continue to decrease, the dimensions of conductors and interconnection elements, which connect and interconnect those integrated circuit devices, also continue to decrease. Dimensions of conductor and interconnection elements which directly contact IC devices have typically decreased the greatest, thus becoming the smallest in dimension of conductor and interconnecting elements within advanced IC's. These narrow conductor and interconnection elements typically comprise the first conductor or interconnection level, which contacts an integrated circuit device. First conductor levels have traditionally been formed from aluminum metal or aluminum metal alloys. First interconnection levels (i.e. first conductive contact studs) are typically formed using tungsten. Conducting lines in the era of micron and sub-micron device features must have a high level of conductivity while simultaneously showing limited susceptibility to degradative phenomenon such as electromigration, a requirement that grows in importance as wire widths decrease. Electromigration may, under extremely high current densities, result in an electrical open and is most common in aluminum metal and aluminum metal alloy conductor and interconnect elements and has not typically been observed in interconnects made of tungsten. Although copper metal and copper metal alloys possess the high electrical conductivity and low electromigration susceptibility desired for conductor elements and interconnection elements within advanced IC's, methods through which copper and copper metal alloys may be formed into conductor and interconnection elements within advanced IC's are neither entirely well developed nor entirely well understood.

Copper is seen as an attractive replacement for aluminum because of its low cost and ease of processing. Copper does however present a particular problem related to copper's high susceptibility to oxidation. Conventional photoresist processing cannot be used when the copper is to be patterned into various wire shapes because the photoresist needs to be removed at the end of the process by heating it in a highly oxidized environment, such as an oxygen plasma, thereby converting it to an easily removed ash.

Chemical Mechanical Polishing (CMP) is a method of polishing materials, such as semiconductor substrates, to a high degree of planarity and uniformity. A typical CMP process involves the use of a polishing pad made from a synthetic fabric and a polishing slurry, which includes pH-balanced chemicals, such as sodium hydroxide, and silicon dioxide particles. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials, is maintained on the polishing pad to modify the polishing characteristics of the polishing pad in order to enhance the polishing of the substrate.

The motion of the wafer relative to the polishing pad creates abrasive action. The pH of the polishing slurry controls the chemical reactions, e.g. the oxidation of the chemicals which comprise an insulating layer of the wafer, while the size of the silicon dioxide particles controls the physical abrasion of the surface of the wafer. The polishing of the wafer is accomplished when the silicon dioxide particles abrade away the oxidized chemicals. An importance parameter during the polishing operation is the polishing efficiency, which is the amount of material that is removed from the surface of the substrate by the CMP process as a function of time. This efficiency is dependent on the density of the pattern or the concentration of the raised areas on the surface that is being polished.

During the CMP process, the allocated polishing time and the downforce exerted on a wafer that is being polished are typically fixed and independent of the topography of the surface that is being polished. The removal rate of material from a wafer has been shown to be directly proportional to the downward force exerted on the surface that is being polished and inversely proportional to the surface area that comes into contact with the polishing pad. The removal rate of material therefore increases as the polished surface decreases, and visa versa. Since different integrated circuits have different surface topographies, the material removed during a CMP process may vary from substrate to substrate and between various layers within a device structure.

The use of metals to interconnect the various elements of a semiconductor device as either intra-level or inter-level connectors has also required considerable attention. Electrical conductors are made of electrically conductive material, a suitable material includes Al, Al alloy, Cu, Cu alloy, Ag, Ag alloy, Si, Ti, Ta, W (tungsten), W alloy, Mo, polysilicon, or a combination thereof and oxides of these metals. Aluminum is typically used as a conductive material, however the use of tungsten and copper for conducting lines or inter-level vias has gained considerable attention in recent years.

Aluminum is typically used in upper-layer wiring. Since however copper has lower resistivity, the use of copper for conductive interfaces is being investigated. Copper is however very difficult to process by Reactive Ion Etch (RIE), the CMP method has therefore been studied for using copper as a wiring material. To polish copper at a high rate of polishing efficiency without causing surface scratching, the copper etch rate must be raised by increasing the amount of the component in the polishing slurry that is responsible for copper etching. If this component is increased to a high level, the etching will become an isotropic etch. Under these conditions, buried copper is etched away causing dishing in the wiring. It is therefore difficult to form highly reliable LSI copper wiring.

The use of copper has become increasingly more important for the creation of multilevel interconnections in semiconductor circuits, however copper lines frequently show damage after CMP and clean. This damage of copper lines causes planarization problems of subsequent layers that are deposited over the copper lines because these layers may now be deposited on a surface of poor planarity. Particularly susceptible to damage are isolated copper lines or copper lines that are adjacent to open fields. While the root causes for these damages are at this time not clearly understood, poor copper gap fill together with subsequent problems of etching and planarization are suspected. Where over-polish is required, the problem of damaged copper lines becomes even more severe.

Current technology makes frequent use of contact plugs that use tungsten or, more recently, copper as filler for the contact openings. A sequence of layers is typically deposited inside the opening for the plug; this process will be highlighted below.

For the formation of metal contact holes, the process typically starts with the deposition of an insulating layer, openings are patterned into this layer in the areas where electrical contacts must be established with the active devices. Next a glue layer (also called seed layer) is deposited on the sidewalls and bottom of the created openings over which a barrier layer (also called nucleation layer) is deposited. The barrier layer serves the purpose of preventing gasses, that are created during the metal deposition, from penetrating into the metal that is being deposited and, in doing so, cause surface dislocations on the deposited metal. Applying a Rapid Thermal Anneal (RTA) immediately after the barrier layer has been deposited and before the metal is deposited can enhance the deposition of the barrier layer. The RTA improves the surface conformity of the deposited barrier layer. With increasingly smaller device dimensions, Chemical Vapor Deposition (CVD) techniques offer the advantage of providing good conformity independent of the thickness of the deposited barrier layer. The deposited layer of metal is etched back. Depositing a layer of a conducting material, for instance aluminum, and patterning this layer into the desired interconnecting pattern can then complete the process of metalization.

The sequence of layers in the hole for the metal plug is now as follows, starting from the bottom of the hole: a seed or glue layer, a nucleation or barrier layer and the metal plug.

FIG. 1 show a cross section of the apparatus used for Prior Art copper CMP end point detection. A laser 10 is mounted such that the laser beam 24 strikes the plane of the polishing table 12 and the polishing pad 14 under an angle that is not perpendicular with the plane of the polishing table 12. It is assumed that the plane of the polishing table 12 is parallel to the plane of the polishing pad 14. The laser beam 24 penetrates the polishing table 12 and the polishing pad 14 and strikes the surface 18 of metal that has been deposited on the surface of wafer 16. The wafer 16 is held and rotated in the conventional manner by the wafer carrier 20 that is mounted on its shaft or axis 22. The laser beam 24 is reflected (26) by the metal surface 18 of wafer 16, the reflected laser beam is captured and its intensity is measured. A high level of reflectivity indicates a thick layer of metal 18 on the surface of the wafer 16, with continued application of the CMP the thickness of the metal layer 18 decreases and, with it, the intensity of the reflected laser beam. When this intensity reaches a certain minimum level, the thickness of the metal layer 18 is reduced to its desired value and the process of CMP of the copper layer is terminated. For metal polishing, all of the deposited metal is typically removed from the surface that is being polished resulting in very low reflection of the laser beam. Only the metal pattern that is desired, such as vias or a metal line pattern, remains exposed to the impending laser beam and will, as such, cause a low level of reflectivity by the surface that is being polished.

U.S. Pat. No. 5,836,805 (Obeng) teaches a CMP endpoint method by analyzing the waste slurry for conductivity, luminescence and/or particulate mass.

U.S. Pat. No. 4,147,564 (Magee et al.) shows an ionizing radiation after a polish step.

U.S. Pat. No. 5,722,875 (Iwashita et al.) shows a CU CMP with endpoint with temperature.

U.S. Pat. No. 5,637,185 (Murarka et al.) discloses a CMP endpoint process based on conductivity of waste slurry.

SUMMARY OF THE INVENTION

A principle objective of the invention is to provide a method of endpoint detection for copper CMP.

It is another objective of the invention to provide a more sensitive method of endpoint detection for copper CMP.

It is another objective of the invention to provide a method other than optical endpoint detection for copper CMP.

It is a further objective of the invention to eliminate inaccuracies in endpoint measurement of copper CMP due to underlying layer surface irregularities.

In accordance with the objectives of the invention, a method is provided whereby copper isotope is added to the deposited layer of copper.

The intensity of the radioactivity of the copper isotope is time dependent and, after initially being at a constant value, decreases rapidly as a function of time.

Under the first embodiment of the invention, a copper isotope is added to the layer of copper that is deposited to form the metal interface. While the copper layer is etched, the radioactivity emitted by the copper layer will decrease since the volume of copper of the layer decreases. Endpoint of the copper CMP is reached at the time when the copper radioactivity starts to rapidly decrease.

Under the second embodiment of the invention, a copper isotope is added to the layer of copper that is deposited to form the metal interface. While the copper layer is etched, the radioactive copper will be removed from the surface that is being planarized and will be removed as copper residue. During copper surface CMP the level of radioactivity in the copper residue will increase. Endpoint of the copper CMP is reached at the time when the radioactivity in the copper residue has increased to a predetermined level.

Under the third embodiment of the invention, a copper isotope is added to the seed layer that has been deposited prior to the deposition of a layer of copper. The deposited layer of copper shields the seed layer and therefore inhibits radioactive radiation. As the copper layer is being polished, its thickness decreases and the radioactive radiation of the seed layer increases. When this radioactive radiation starts to rapidly increase, the copper CMP is considered complete.

BRIEF DESCRIPTION OF THE DRAWINGS

FIG. 1 shows a cross section of the Prior Art method of copper CMP end point detection.

FIG. 2 relates to the first and second embodiment of the invention and shows a cross section of a layer of copper deposited over the top surface of a first level of metal where copper isotope has been added to the deposited copper.

Figure 3:
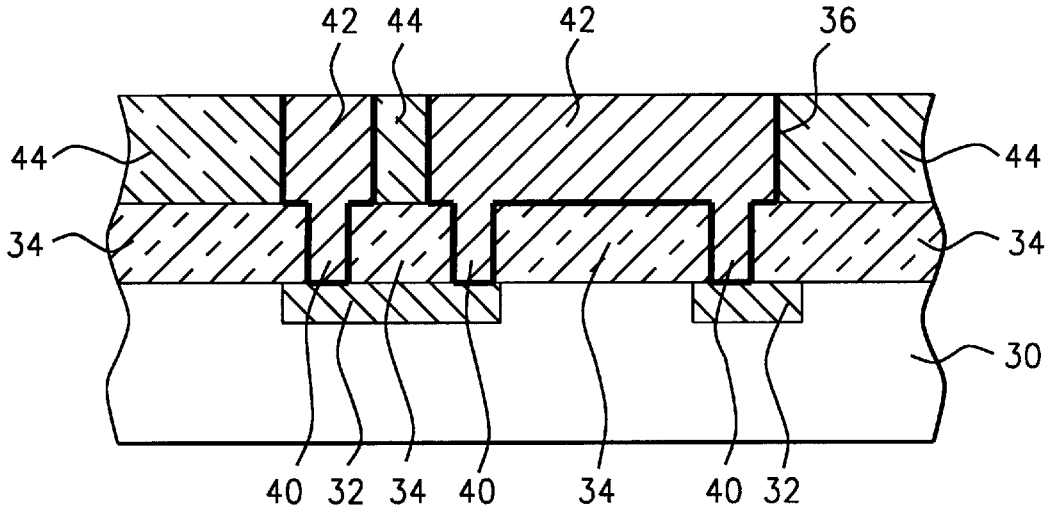
FIG. 3 further relates to the first and second embodiment of the invention and shows a cross section of the etched back layer of copper (to which a copper isotope has been added) deposited over the top surface of a first level of metal.

DETAILED DESCRIPTION OF THE PREFERRED EMBODIMENTS.

An isotope constitutes one or more species of atoms of the same chemical element that have the same atomic number and that occupy the same position in the periodic table and that are nearly identical in chemical behavior but differ in atomic mass or mass number and so behave differently in the mass spectrograph, in radioactive transformations and in physical properties and may be detected by means of these differences. An isotope for a specific element is depicted by the mass number that follows the name of the element or is written superior (superscript) to the symbol of the element. For the invention, the element is copper; the isotopes that are used are $Cu^{63}$, $Cu^{65}$ and $Cu^{67}$. It is known that native copper has $Cu^{63}$ and $Cu^{65}$, to increase radioactive radiation, small amounts of $Cu^{67}$ may be added to the native copper.

FIGS. 2 through 5 address the first and second embodiment of the invention.

Referring now specifically to FIG. 2, there is shown a cross section of a first level of metal 32, created on the surface of a Intra Level Dielectric (ILD) 30, a level 34 of Inter Metal Dielectric (IMD) has been deposited over the surface of the substrate 30 and patterned to created a pattern of vias 40. After the vias have been patterned, a second layer 44 of dielectric is deposited and patterned for the metal line pattern 42. A barrier/seed layer 36 is next blanket deposited over the surface of the via openings 40 and the openings 42 for the metal line pattern, a layer 46 of copper is next deposited over the seed layer 36. The cross section as shown in FIG. 2 is now ready for CMP of the deposited layer 46 of copper; this CMP typically proceeds down to the top surface of the second layer of dielectric 44. The native copper that forms layer 46 contains $Cu^{63}$ and $Cu^{65}$ while small amounts of $Cu^{67}$ may be added to the native copper of layer 46 for increased sensitivity of measurement of the isotopic radiation. The copper isotopes will, during CMP of the copper surface, be present in both the surface of the plane that is being polished and in the copper residue that is removed from the surface that is being polished. The presence of the copper isotopes in the layer 46 that is being polished will, during CMP of the copper surface, decrease. The radioactive radiation of the copper on the surface of the dielectric 44 will decrease accordingly. Inversely, copper isotopes present in the copper residue removed from the surface that is being polished will increase and, with it, the radioactive radiation of the copper residue will increase. In both cases, a point in time can be established where the copper from the surface of the dielectric 44 has been removed at which time the copper CMP process is complete.

FIG. 3 shows a cross section of the substrate 30 and the deposited levels of metalization 32/42 after the process of copper surface polishing has been completed. The top level 42 of metal interconnect lines is connected to the first level 32 of metal interconnect lines by means of vias 40. The copper that had been deposited on the surface of the second layer 44 of dielectric has been polished away down to the top surface of this second dielectric layer 44.

Figure 4:
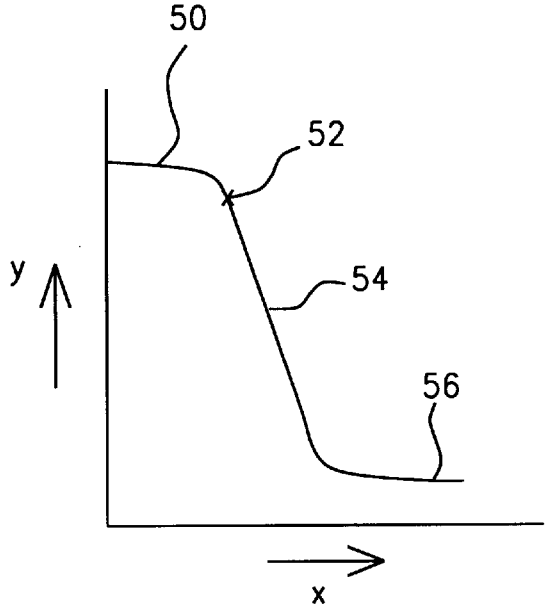
FIG. 4 also relates to the first and second embodiment of the invention and shows the time dependency of the intensity of radiation of the copper isotope contained within the deposited layer of copper.

FIG. 4 relates to the radioactive radiation of the copper layer 46 (FIG. 2) and shows a curve of the intensity of the radioactive radiation (indicated along the Y-axis) of the copper isotopes as a function of time (indicated along the X-axis). Initially, at the time that there is still a significant amount of copper on the surface of dielectric 44, the radiation is constant and at a high level 50, FIG. 4. While the copper is being removed, fewer copper isotopes are present in the copper on the surface of the dielectric 44, when the point is reached in the copper CMP process where no more copper (and therefore no more copper isotopes) is present on the surface of the dielectric 44, the radiation decreases rapidly, as indicated with point 52, FIG. 4. Point 52 therefore represents the end point for the copper CMP process. The radiation continues to decrease rapidly, section 54 until the point is reached where it reaches a low-level plateau 56. The rapid decrease 54 is indicative of the final removal of copper containing slurry from the surface of the dielectric 44, point 56 indicates that all copper residue and with it all copper isotopes has been removed form the surface of dielectric 44.

Figure 5:
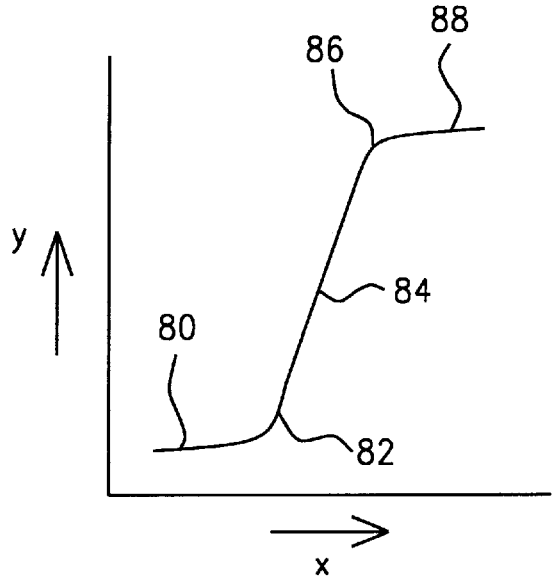
FIG. 5 relates to the first and second embodiment of the invention and shows the time dependency of the intensity of radiation of the copper isotope contained within the slurry that is removed from the surface of the layer of copper that is being polished.

FIG. 5 relates to the radioactive radiation of the copper slurry that is removed during CMP of the layer 46 (FIG. 2) of copper and shows a curve of the intensity of the radioactive radiation (indicated along the Y-axis) of the copper isotopes as a function of time (indicated along the X-axis). Initially, at the time that no significant amount of slurry has been removed as a result of the copper CMP process, the radiation is constant and at a low level 80, FIG. 5. The CMP process starts at point 82. While the copper is being removed, an increasing number of copper isotopes will be present in the copper of the slurry, resulting in a rapid increase in the radioactive radiation emitted by the slurry as shown by section 84 of the curve. When the point is reached in the copper CMP process where no more copper (and therefore no more copper isotopes) is removed from the surface of the dielectric layer 44 (FIG. 2), point 86 in FIG. 5, the radiation will not increase any further and will remain on a high level of radiation 88. Point 86 indicates that all copper residue and with it all copper isotopes has been removed form the surface of dielectric 44, point 86 therefore represents the end-point for the copper CMP process.

Figure 6:
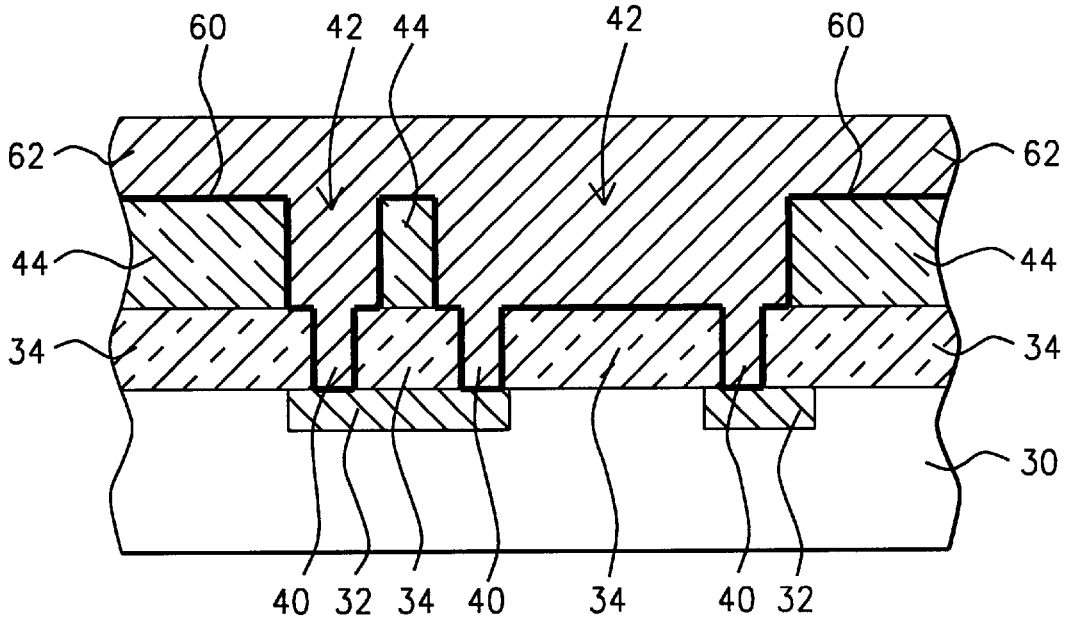
FIG. 6 relates to the third embodiment of the invention and shows a cross section of a layer of copper deposited over the top surface of a first level of metal where copper isotope has been added to the created seed layer.
Figure 7:
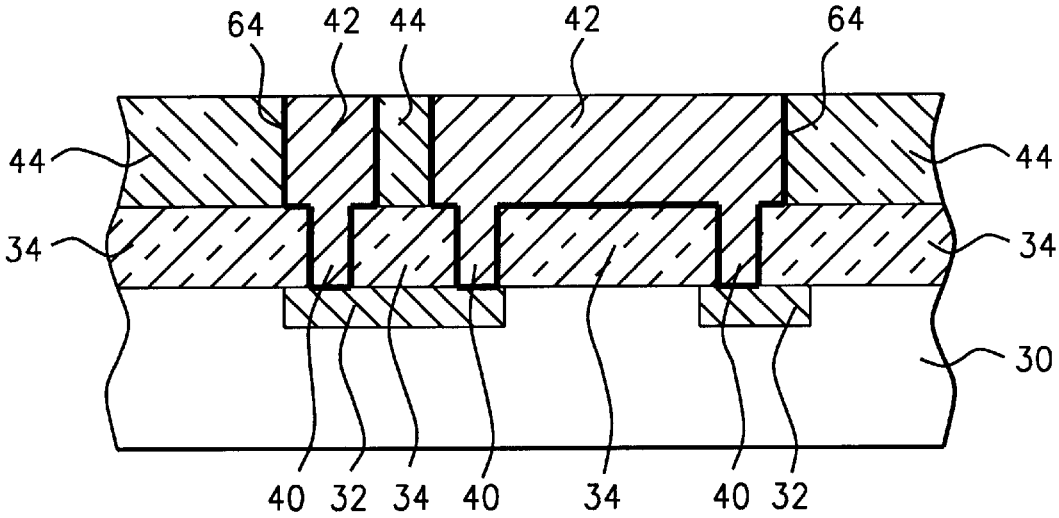
FIG. 7 further relates to the third embodiment of the invention and shows a cross section of the etched back layer of copper that has been deposited over the top surface of a seed layer to which a copper isotope has been added.
Figure 8:
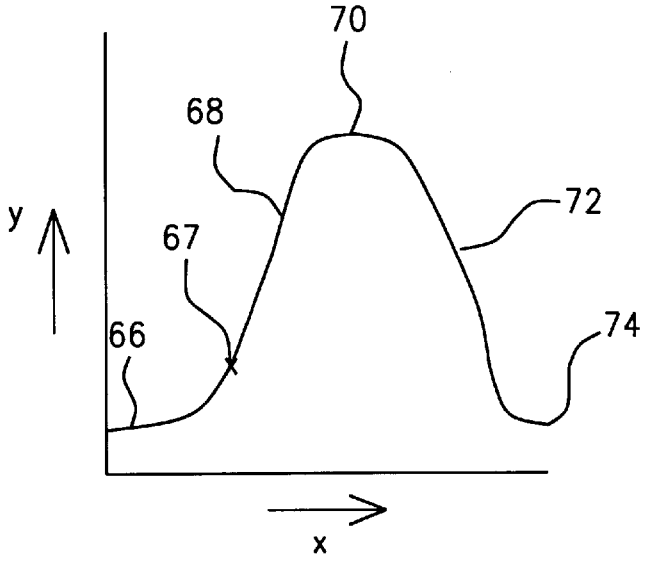
FIG. 8 also relates to the third embodiment of the invention and shows the time dependency of the intensity of radiation of the copper isotope contained within the seed layer.

FIGS. 6 through 8 address the third embodiment of the invention.

Referring specifically to FIG. 6, there is shown a cross section of the substrate with two levels of metal that is identical in its structural detail to the cross section shown in FIG. 2. Where FIG. 6 differs from FIG. 2 is that the seed layer 60 contains copper to which copper isotopes have been added. This addition of isotopes makes the seed layer 60 radioactive. Layer 62 is native copper with no addition of copper isotopes (as opposed to layer 46 in FIG. 2 to which copper isotopes have been added). The radioactivity of the seed layer 60 is, prior to the CMP process of layer 62, shielded from radiating by layer 62. Once the copper CMP process starts, copper is removed from the surface of dielectric 44 thereby reducing the shielding of the radioactive radiation of seed layer 60. While the copper surface CMP process continues, the shielding of the radioactive radiation by seed layer 60 will slowly diminish until the point is reached where no more copper is present on the surface of the dielectric 44 which removes the radiation inhibitor. Monitoring the radiation that emanates from the seed layer can therefore readily identify the point where copper CMP is complete.

FIG. 7 shows a cross section of the substrate and the deposited levels of metalization after the process of copper surface polishing has been completed. This FIG. 7 is, in structural detail, identical to FIG. 3. The remnants 64 of the seed layer continue to contain the original level of copper isotopes. These isotopes have no further effect since they are shielded from the remainder of the device structure by the copper vias 40 and the second level of metal 42. The top level 42 of metal interconnect lines is connected to the first level 32 of metal interconnect lines by means of vias 40. The copper that had been deposited on the surface of the second layer 44 of dielectric has been polished away down to the top surface of this second dielectric layer 44.

FIG. 8 shows a graph of the intensity of the radioactive radiation (indicated along the Y-axis) of the copper isotopes contained in the seed layer 60 as a function of time (indicated along the X-axis). Initially, at the time that there is still a significant amount of copper on the surface of dielectric 44, the radiation is constant and at a very low level 66. While the copper is being removed, less native copper is present on the surface of the dielectric 44, thereby reducing the shielding of the radioactive radiation by the isotopes contained in the seed layer 60. When the point is reached in the copper CMP process where no more copper (and therefore no more radiation shield) is present on the surface of the dielectric 44, the radiation by the copper isotopes contained in the seed layer 60 starts to increase rapidly, as indicated with point 67, FIG. 8. Point 67 therefore indicates the completion of the copper CMP process. The radiation continues to increase rapidly, section 68, FIG. 8, until the point is reached where it reaches a peak 70. The rapid decrease 72 is indicative of the final removal of the copper seed layer from the surface of the dielectric 44, point 70 indicates that all copper and therewith all copper isotopes has been removed from the surface of dielectric 44. Section 72 represents the final removal of the top surface of the seed layer, where this radiation (of the seed layer) is initially at a high level it rapidly decreases while the seed layer is being removed. The radioactive radiation by the copper isotopes contained in the remainder (64, FIG. 7) of the seed layer is, as previously indicated, inhibited by the overlying layers of metal (the second layer of metal 42, FIG. 7 and the vias 40, FIG. 7) as indicated by section 74, FIG. 8.

The third embodiment of the invention does not lend itself to monitoring the presence of copper isotopes in the copper slurry or particles that are removed from the dielectric surface since there are essentially no isotopes present in these materials.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. A method of end-point detection during polishing of copper surfaces within a semiconductor substrate, comprising:

polishing a substrate having an overlying layer of copper with a polishing slurry, said polishing slurry producing waste slurry; measuring the radioactive radiation of said layer of copper; and terminating said polishing operation after said radioactive radiation starts to decrease.

2. The method of claim 1 wherein said radioactive radiation of said layer of copper has a decreasing slope as a function of time and in which at least a portion of said decreasing slope is extrapolated to determine the time at which said polishing is to be terminated.

3. The method of claim 1 wherein said radioactive radiation of said layer of copper is caused by $Cu^{63}$ and $Cu^{65}$ isotopes present in native copper.

4. The method of claim 1 wherein said radioactive radiation of said layer of copper is augmented by the addition of $Cu^{67}$ isotopes.

5. The method of claim 1 wherein said layer of copper has been formed in contact with a dielectric layer, whereby a copper seed layer has been created as in interface between said layer of copper and said dielectric layer, said dielectric layer having a copper pattern therein whereby said copper pattern may contain a pattern of copper interconnect lines thereby including copper vias and whereby said polishing operation is terminated where substantially all of said copper covering said dielectric has been removed from the surface of said dielectric, said copper still filling said pattern of copper interconnect lines thereby including copper vias.

6. A method of end-point detection during polishing of copper surfaces within a semiconductor substrate, comprising:

polishing a substrate having an overlying layer of copper with a polishing slurry, said polishing slurry producing a waste slurry;

measuring the radioactive radiation of said waste slurry; and terminating said polishing operation after said radioactive radiation starts to increase.

7. The method of claim 6 wherein said radioactive radiation of said slurry waste has an increasing slope as a function of time and in which at least a portion of said increasing slope is extrapolated to determine the time at which said polishing is to be terminated.

8. The method of claim 6 wherein said radioactive radiation of said slurry waste is caused by $Cu^{63}$ and $Cu^{65}$ isotopes present in said copper surface.

9. The method of claim 7 wherein said radioactive radiation of said slurry waste is augmented by the addition of $Cu^{67}$ isotopes to said copper surface.

10. The method of claim 7 wherein said layer of copper has been formed in contact with a dielectric layer, whereby a copper seed layer has been created as in interface between said layer of copper and said dielectric layer, said dielectric layer having a copper pattern therein whereby said copper pattern may contain a pattern of copper interconnect lines thereby including copper vias and whereby said polishing operation is terminated where substantially all of said copper covering said dielectric has been removed from the surface of said dielectric, said copper still filling said pattern of copper interconnect lines thereby including copper vias.

11. A method of end-point detection during polishing of copper surfaces within a semiconductor substrate, comprising:

polishing a substrate having an overlying layer of copper with a polishing slurry, said polishing slurry producing a waste slurry said overlying layer of copper having been deposited over a cooper seed layer;

measuring the radioactive radiation of said copper seed layer; and terminating said polishing operation after said radioactive radiation starts to increase.

12. The method of claim 11 wherein said radioactive radiation of said copper seed layer has a increasing slope as a function of time and in which at least a portion of said increasing slope is extrapolated to determine the time at which said polishing is to be terminated.

13. The method of claim 11 wherein said radioactive radiation of said copper seed layer is caused by $Cu^{63}$ and $Cu^{65}$ isotopes present in native copper augmented by the addition of $Cu^{67}$ isotopes to the copper seed layer.

14. The method of claim 11 wherein said layer of copper has been formed in contact with a dielectric layer, whereby a copper seed layer has been created as in interface between said layer of copper and said dielectric layer, said dielectric layer having a copper pattern therein whereby said copper pattern may contain a pattern of copper interconnect lines thereby including copper vias and whereby said polishing operation is terminated where substantially all of said copper covering said dielectric has been removed from the surface of said dielectric, said copper still filling said pattern of copper interconnect lines thereby including copper vias.

* * * * *